US007641187B2

(12) United States Patent
Sonoda

(10) Patent No.: US 7,641,187 B2
(45) Date of Patent: Jan. 5, 2010

(54) AUTOMATIC SHEET FEEDING APPARATUS AND RECORDING APPARATUS

(75) Inventor: Shinya Sonoda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 208 days.

(21) Appl. No.: 11/147,223

(22) Filed: Jun. 8, 2005

(65) Prior Publication Data

US 2005/0275154 A1 Dec. 15, 2005

(30) Foreign Application Priority Data

Jun. 14, 2004 (JP) ..... 2004-175222

(51) Int. Cl.
*B65H 3/06* (2006.01)

(52) U.S. Cl. ..... 271/119; 271/122

(58) Field of Classification Search ..... 271/119, 271/122

See application file for complete search history.

(56) References Cited

U.S. PATENT DOCUMENTS

| | | | | |
|---|---|---|---|---|
| 5,655,762 | A * | 8/1997 | Yergenson | 271/121 |
| 5,882,004 | A * | 3/1999 | Padget | 271/119 |
| 5,895,039 | A * | 4/1999 | Kato et al. | 271/124 |
| 5,997,198 | A | 12/1999 | Murayama et al. | 400/624 |
| 6,059,281 | A * | 5/2000 | Nakamura et al. | 271/119 |
| 6,135,444 | A * | 10/2000 | Padget | 271/121 |
| 6,341,774 | B1 * | 1/2002 | Ueda | 271/119 |
| 6,663,098 | B2 * | 12/2003 | Teo et al. | 271/121 |
| 6,824,132 | B2 * | 11/2004 | Asai et al. | 271/125 |
| 7,374,162 | B2 * | 5/2008 | Sonoda et al. | 271/121 |
| 2002/0175462 | A1 * | 11/2002 | Sonoda et al. | 271/121 |
| 2004/0005159 | A1 * | 1/2004 | Ito et al. | 399/50 |
| 2005/0275705 | A1 | 12/2005 | Nitta et al. | 347/104 |

FOREIGN PATENT DOCUMENTS

| | | |
|---|---|---|
| JP | 2002-332130 | 11/2002 |
| JP | 2002-332142 | 11/2002 |
| JP | 2003-026345 | 1/2003 |
| JP | 2003-54779 | 2/2003 |
| JP | 2003-104577 | 4/2003 |

* cited by examiner

*Primary Examiner*—Patrick H Mackey
*Assistant Examiner*—Howard Sanders
(74) *Attorney, Agent, or Firm*—Fitzpatrick, Cella, Harper & Scinto

(57) ABSTRACT

Automatic sheet feeding apparatus/recording apparatus include a feed roller 11 for feeding sheets out of a stack holding unit, a separation roller 12, in contact with the feed roller 11, for separating the sheets one by one; a return lever 13 for pushing back sheets to the stack holding unit and aligning them; and flanges 14 integrally turning with the feed roller; wherein the feed roller 11 and the return lever 13 do not overlap with each other but the flanges 14 and the return lever 13 do overlap in a side view during one turn of the feed roller 11.

With the configuration, the apparatus can utilize the sheet conveying face of the feed roller longer and more effectively, and to eliminate the rush-in phenomenon, namely letting the tips of sheets enter deep into the feeding apparatus inadvertently at the time of setting the sheets into the sheet stack holding unit.

12 Claims, 10 Drawing Sheets

AUTOMATIC SHEET FEEDING APPARATUS AND RECORDING APPARATUS

BACKGROUND OF THE INVENTION

1. Field of the Invention

The present invention relates to an automatic sheet feeding apparatus for stacked sheets separating from one another and feeding them one by one, and a recording apparatus having the automatic sheet feeding apparatus.

2. Description of the Related Art

A recording apparatus for forming images on sheets, such as a printer, copying machine or facsimile, or a reading apparatus (scanner) for reading images on sheets of subject copies, uses an automatic sheet feeding apparatus which separates a plurality of sheet stacked in a stack holding unit and feeding the sheets one by one. In such an automatic sheet feeding apparatus, there is a possibility that separation of the sheets fails and overlap feeding occurs, that is, two or more sheets are fed together in an overlapped manner. Various measures are taken to prevent such overlap feeding.

Typical examples of automatic sheet feeding apparatus having an overlap feeding prevention mechanism include a retard roller system which forcibly turns separating rollers via a torque limiter in a direction reverse to the sheet feeding direction and a return lever system having a return lever, which is operated every time a prescribed number of sheets have been fed to return the leading edges of sheets to a prescribed position. Mechanisms using a return lever include an invention disclosed in U.S. Pat. No. 5,997,198 for instance, a bidirectional rotation control type in which a drive unit of the automatic sheet feeding apparatus is turned in the forward direction to feed sheets and the drive unit is turned in the reverse direction to operate the return lever and thereby return the sheets to a prescribed position. Another is an invention disclosed in Japanese Patent Application Laid-Open No. 2003-54779, a unidirectional rotation control type in which the drive unit of the automatic sheet feeding apparatus is used for rotation only in one direction.

FIG. 9 is a side view of one example of conventional automatic sheet feeding apparatus disclosed in U.S. Pat. No. 5,997,198, and FIG. 10 is a side view of another example of conventional automatic-sheet feeding apparatus disclosed in Japanese Patent Application Laid-Open No. 2003-54779. In the bidirectional rotation control type automatic sheet feeding apparatus disclosed in U.S. Pat. No. 5,997,198, as shown in FIG. 9, a return lever 180 and feed roller conveyance faces 121 are so positioned as to overlap each other, in order to prevent a plurality of sheets, when they are set in a stack holding unit (at the time of sheet setting), from rushing into the sheet feeding apparatus. Or in the unidirectional rotation control type automatic sheet feeding apparatus disclosed in Japanese Patent Application Laid-Open No. 2003-54779, as shown in FIG. 10, a return lever 11 and a lock lever 21 are so positioned as to overlap each other in order to prevent sheets from rushing into the sheet feeding apparatus at the time of sheet setting.

However, working the mechanism to prevent sheets from rushing at the time of sheet setting in either example of the prior art described above is subject to a number of constraints. For instance, the arrangement of so positioning the return lever and the feed roller conveyance faces as to overlap each other involves an inconvenience that the drive configuration and the control thereof are made complex when driving in the direction reverse to sheet conveyance is to be used. Further, this arrangement of so positioning the return lever and the feed roller conveyance faces as to overlap each other involves another inconvenience that, when driving in the sheet conveying direction is to be used, the circumference of the feed roller cannot be effectively used long enough as sheet conveyance faces, with the consequence that the feed means tends to become large. Moreover, if sheets are carelessly inserted when they are to be set in the sheet stack holding unit, the sheets may rush into the sheet feeding apparatus, resulting in a problem in the handling facility of sheet setting. Further in the configuration of so positioning the return lever and the lock lever as to overlap each other, the number of components increase to complicate the mechanism, inviting a larger size or a higher cost.

SUMMARY OF THE INVENTION

An object of the present invention is to provide an automatic sheet feeding apparatus capable of utilizing the sheet conveyance face of a feed roller effectively and preventing the rushing of sheets into the sheet feeding apparatus at the time of setting sheets into the sheet stack holding unit.

Another object of the invention is to provide an automatic sheet feeding apparatus comprising a stack holding unit on which sheets are to be stacked; a feed roller for feeding sheets stacked on the stack holding unit, the feed roller having a cylindrical sheet conveying face and a non-conveying face which escapes from a sheet conveying path; separating means, in contact with the feed roller, for separating the sheets; a return lever for returning sheets conveyed downstream from the separating means to the stack holding unit; and flanges arranged coaxially with the feed roller, wherein the flange and the return lever protrude into the sheet conveying path in a standby state of the feed roller.

BRIEF DESCRIPTION OF THE DRAWINGS

FIG. 4A, a front view; FIG. 4B, a side view of the feed roller as taken along line A-A in FIG. 4A; and FIG. 4C, a side view of a flange as taken along line B-B in FIG. 4A;

DETAILED DESCRIPTION OF THE PREFERRED EMBODIMENT

Figure 1:
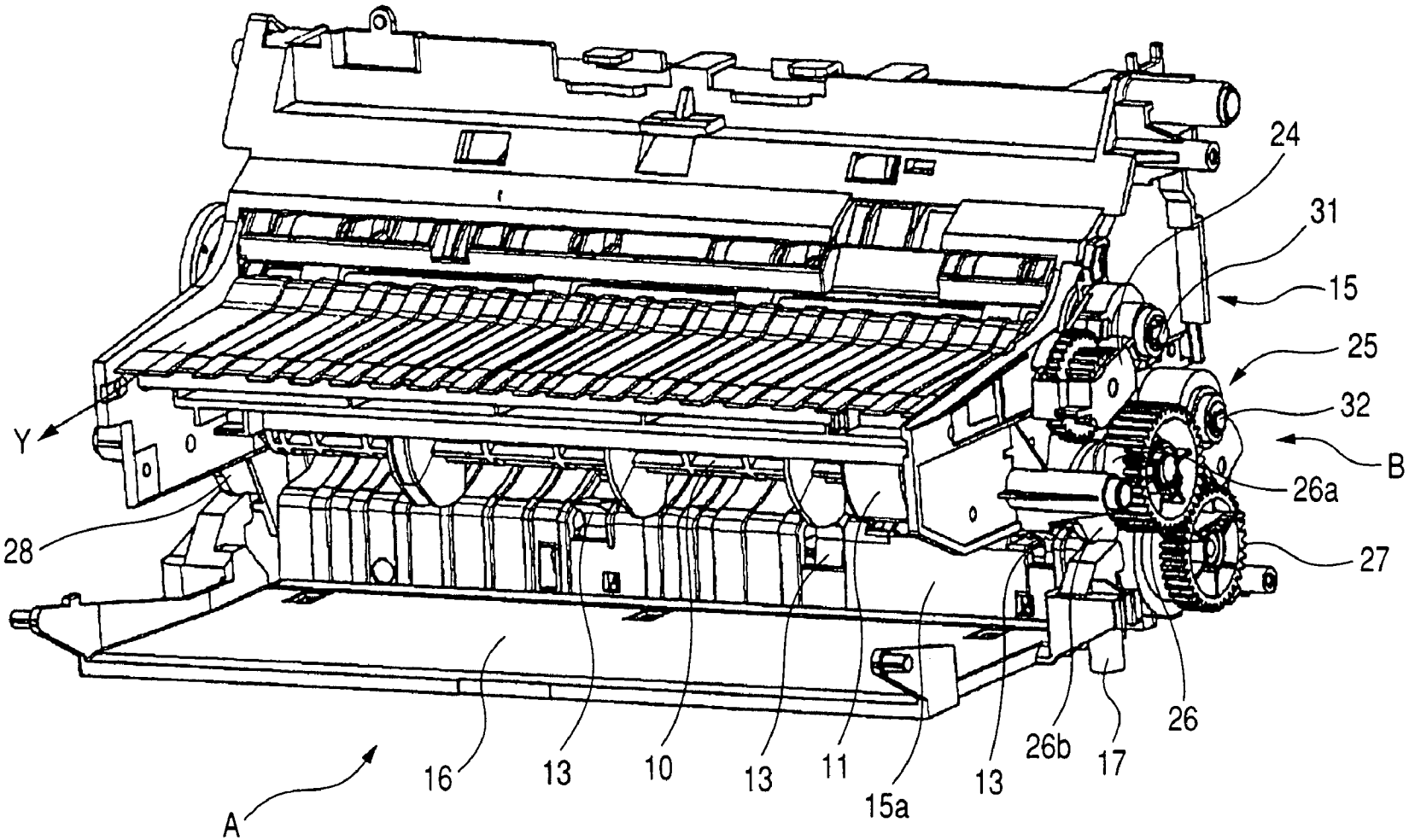
FIG. 1 shows a perspective view of an automatic sheet feeding apparatus, which is a preferred embodiment of the present invention.
Figure 2:
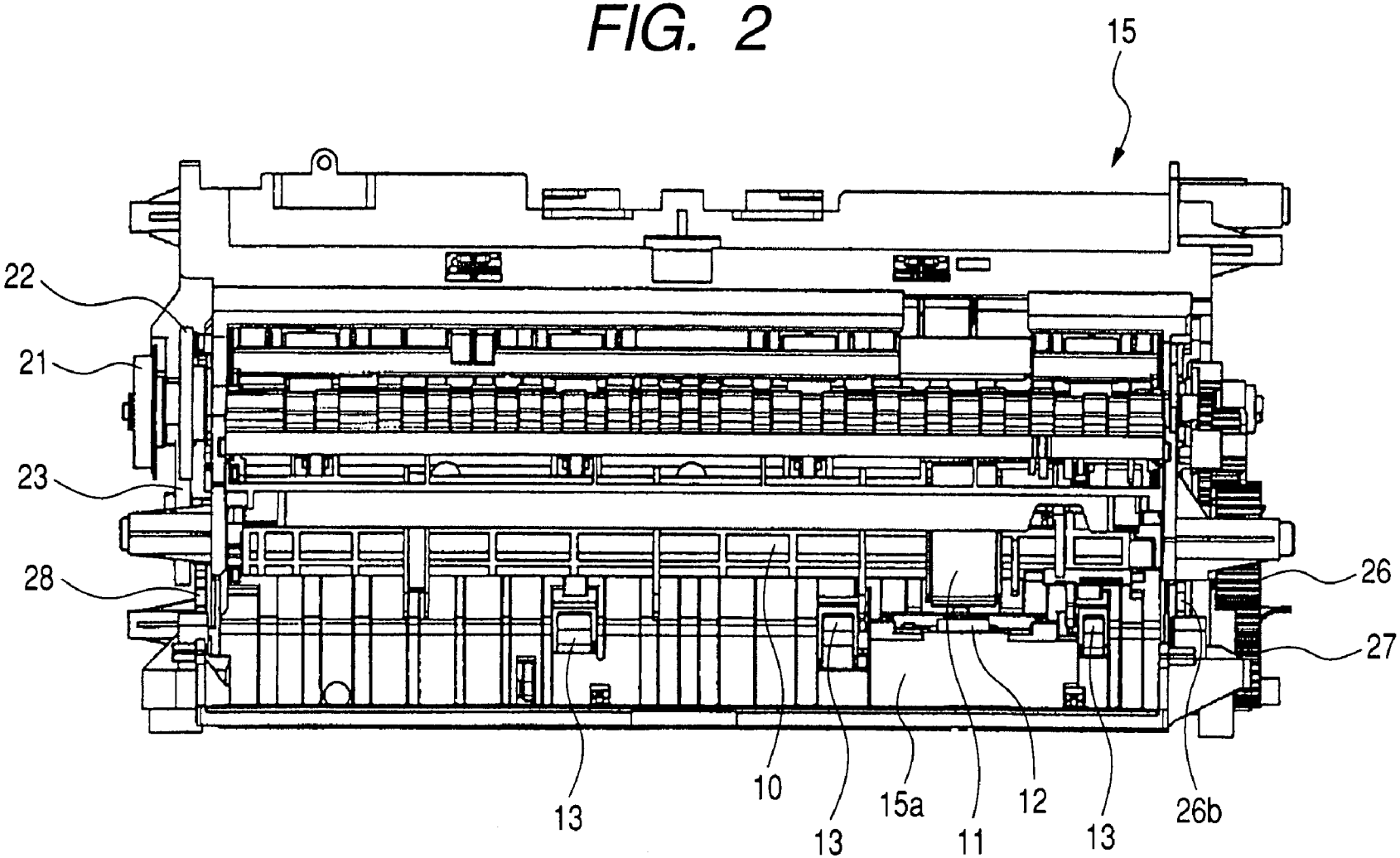
FIG. 2 shows a front view of the automatic sheet feeding apparatus of FIG. 1 as seen in the direction of arrow A in FIG. 1.

A preferred embodiment of the present invention will be described in specific terms below with reference to accompanying drawings. Throughout these drawings, the same reference signs denote respectively the same or corresponding items. FIG. 1 shows a perspective view of an automatic sheet feeding apparatus, which is a preferred embodiment of the invention, and FIG. 2, a front view of the automatic sheet feeding apparatus of FIG. 1 in the direction of arrow A in FIG. 1. In FIG. 1 and FIG. 2, reference numeral 10 denotes a feed shaft which supports and turns a feed roller; 11, a feed roller for feeding sheets; and 12, a separation roller for separating the topmost sheet which is to be fed. Further, reference numeral 13 denotes a return lever for preventing the overlap feeding, that is, preventing a plurality of sheets from being fed together in overlapped manner; 14, flanges formed integrated with the feed shaft 10 of the feed roller; and 15, a feed base constituting the frame of the automatic sheet feeding apparatus. Reference numeral 16 denotes a pressure plate (stack holding unit) for holding sheets and pressing the held sheets against the feed roller 11; and 17, pressure plate springs for urging the pressure plate 16 toward the feed roller 11.

Figure 3:
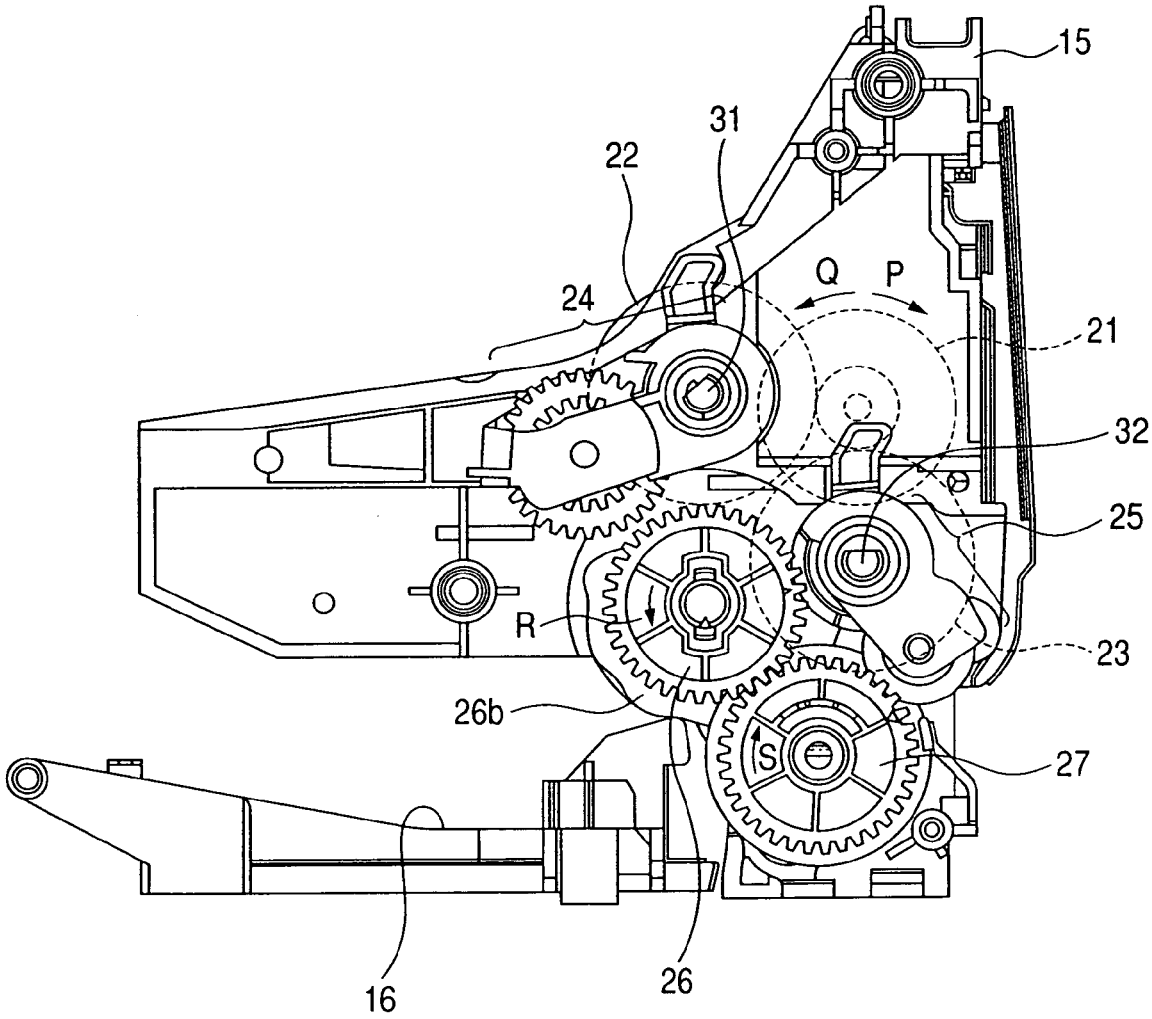
FIG. 3 is a side view of the drive mechanism of the automatic sheet feeding apparatus of FIG. 1 as seen in the direction of arrow B in FIG. 1.
Figure 4A:
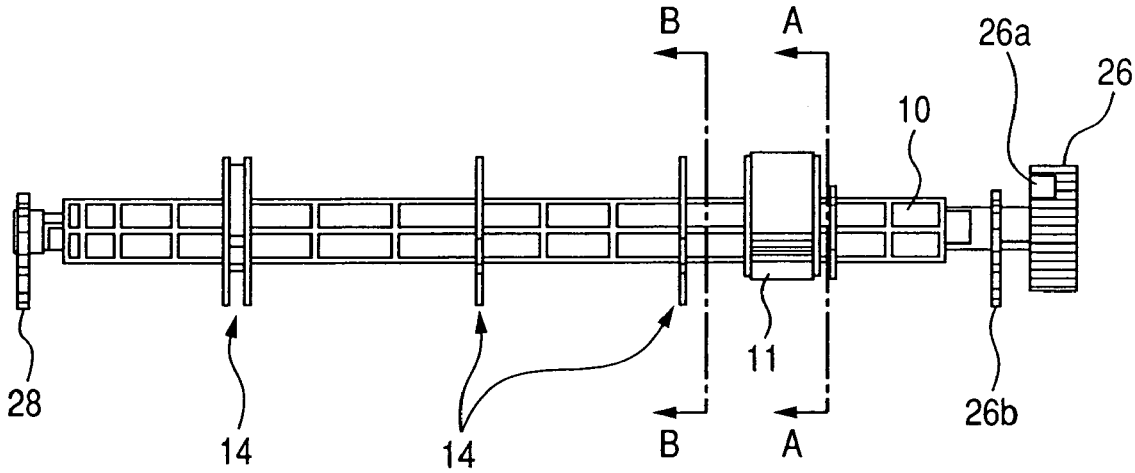
FIGS. 4A, 4B and 4C show the feed roller of the automatic sheet feeding apparatus, which is the preferred embodiment of the invention.
Figure 4C:
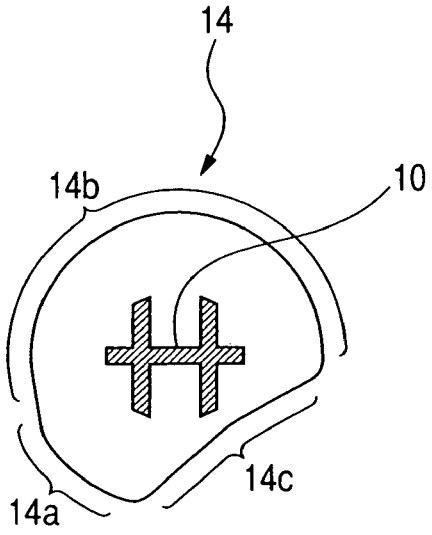
Figure 4B:
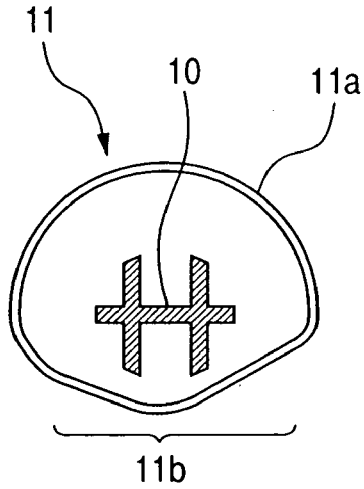
Figure 5:
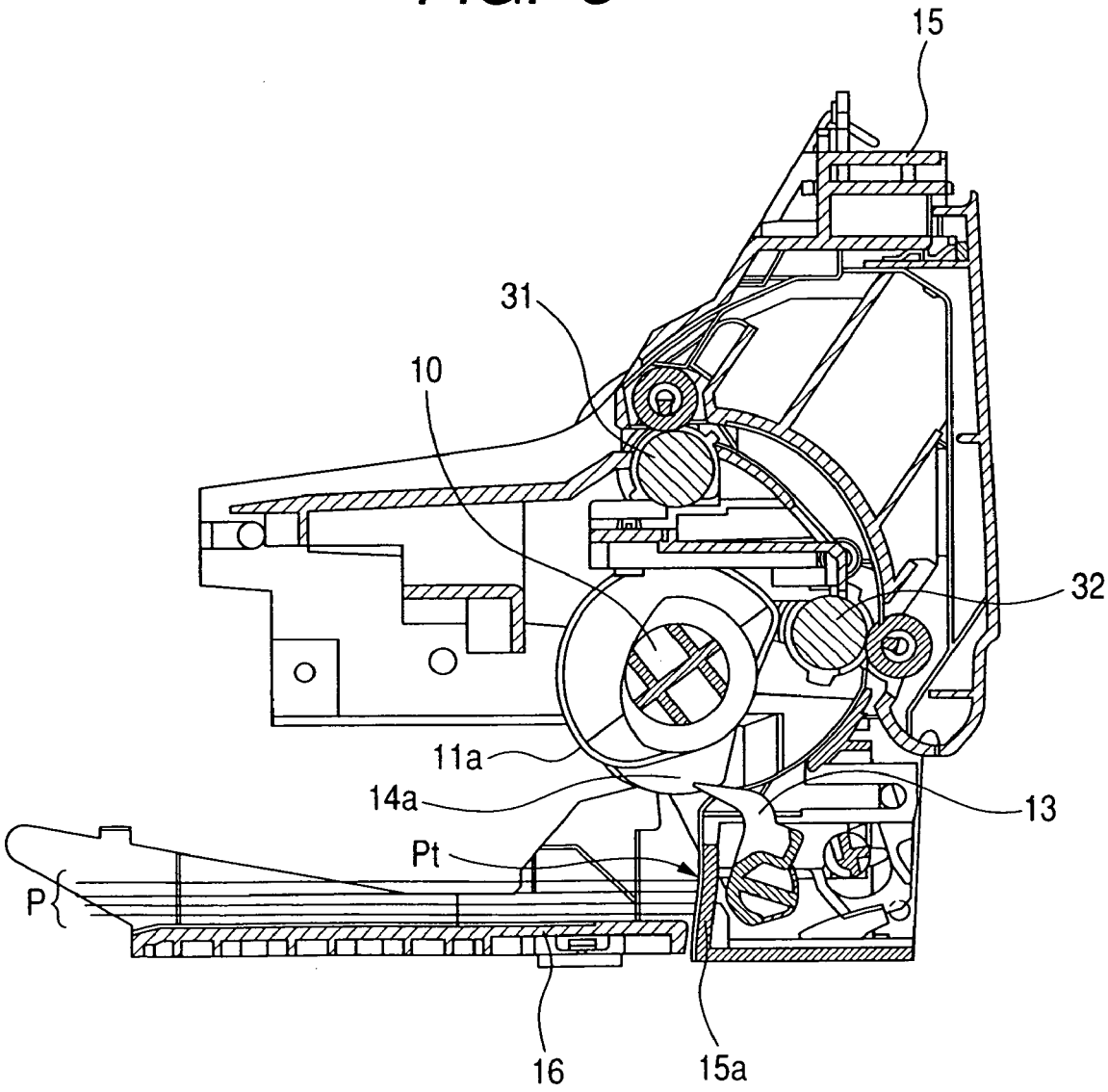
FIG. 5 shows a vertical section of the automatic sheet feeding apparatus, which is the embodiment of the invention, in a state of standing by for feeding.
Figure 6:
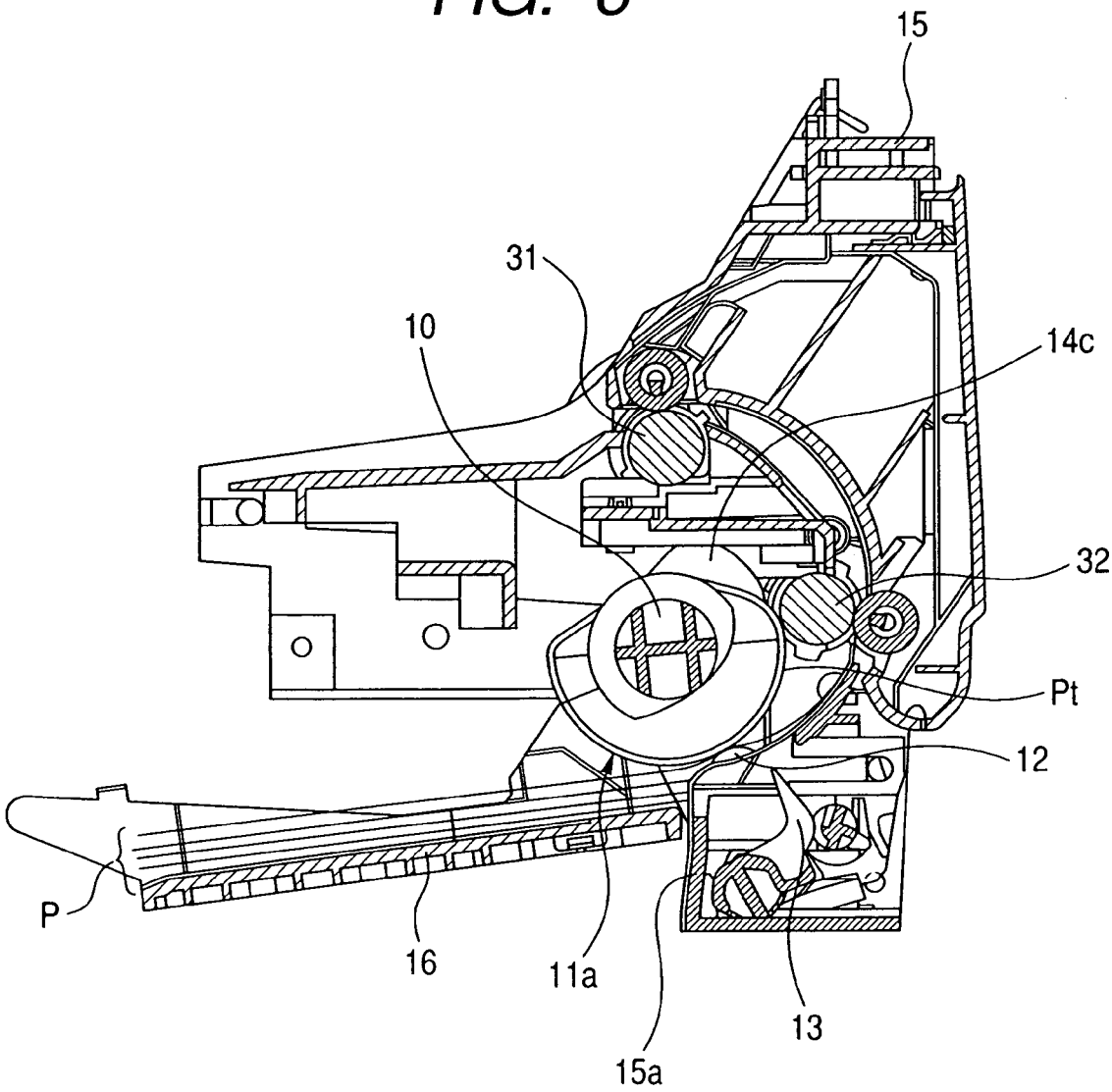
FIG. 6 shows a vertical section of the automatic sheet feeding apparatus of FIG. 5 in a state of feeding operation.

FIG. 3 is a side view of the drive mechanism of the automatic sheet feeding apparatus of FIG. 1 viewed in the direction of arrow B in FIG. 1. FIGS. 4A to 4C show the feed roller of the automatic sheet feeding apparatus, which is the preferred embodiment of the invention: FIG. 4A, a front view; FIG. 4B, a side view of the feed roller as taken along line A-A in FIG. 4A; and FIG. 4C, a side view of the flange as taken along line B-B in FIG. 4A. FIG. 5 shows a vertical section of the automatic sheet feeding apparatus, which is the preferred embodiment of the invention, in a state of standing by for feeding; FIG. 6, a vertical section of the automatic sheet feeding apparatus of FIG. 5 in a state of feeding operation; and FIG. 7, a vertical section of the automatic sheet feeding apparatus of FIG. 5 in a state of having ended the feeding operation and completed preparations for processing of the sheets (such as recording by a printer or some other recording apparatus).

Referring to FIG. 1 through FIG. 7, the automatic sheet feeding apparatus, which is the preferred embodiment of the invention, is provided with a sheet stack holding unit, a feeding/separating unit, drive mechanism and an overlap feeding prevention unit. First, the sheet stack holding unit will be described. The sheet stack holding unit is having a leading edge reference part 15*a* formed on the feed base 15 and the pressure plate 16 on which a plurality of sheets are set in a stacked state. This pressure plate constitutes the sheet stack holding unit. In a standby state in which the automatic sheet feeding apparatus is not conveying (feeding) sheets, the pressure plate 16 is held in a prescribed position away from the feed roller 11, and in this standby state a sufficient gap is secured between the feed roller 11 and the pressure plate 16 to allow a plurality of sheets to be set and stacked therein. The sheets set on the pressure plate 16 are held in a state in which their tips are pressed against the leading edge reference part 15*a* by a rear edge guide (not shown) positioned toward the front. Incidentally in this embodiment of the invention, the leading edge reference part 15*a* is formed in a rib shape to minimize the load at the time of feeding.

Figure 8:
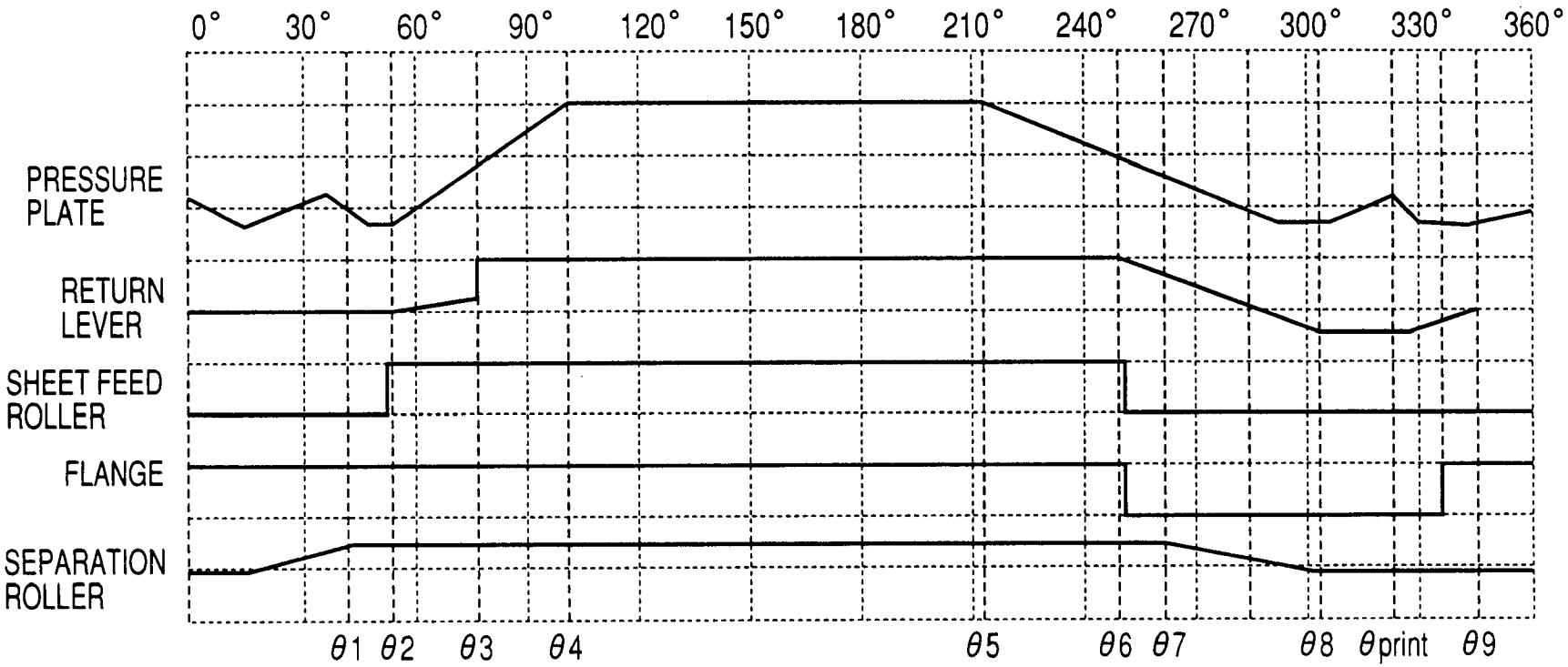
FIG. 8 is a timing chart showing the mutual relationships of the operations of the constituent elements of the automatic sheet feeding apparatus, which is the embodiment of the invention.
Figure 9:
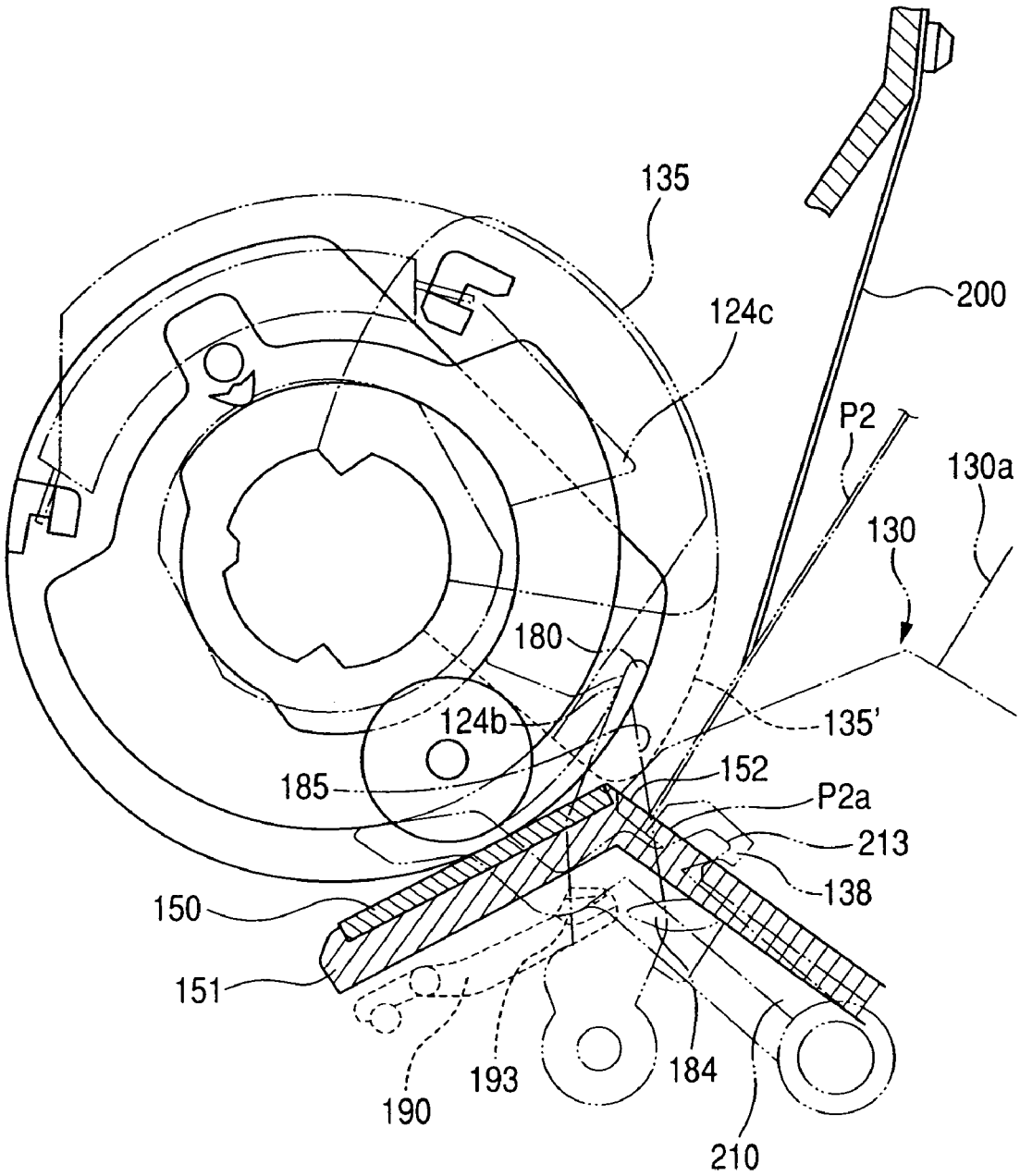
FIG. 9 is a side view of one example of conventional automatic sheet feeding apparatus.
Figure 10:
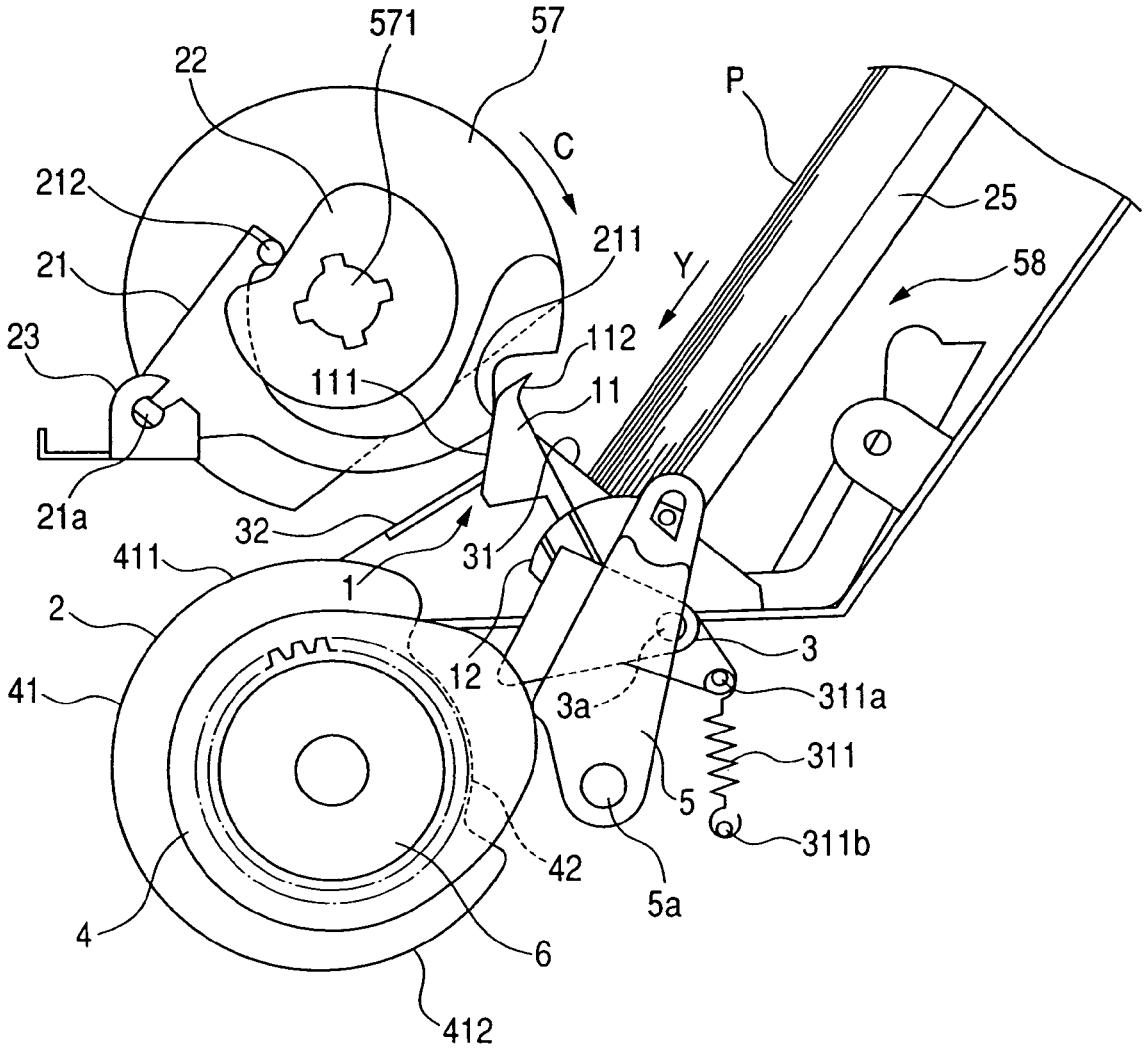
FIG. 10 is a side view of another example of conventional automatic sheet feeding apparatus.

The pressure plate 16 is turnably fitted to the feed base 15 by a spindle 16*a* provided at the end toward the front. The actions of the pressure plate 16 are restricted by springs and cams. Thus, the pressure plate 16 is turnably urged toward the feed roller 11 by the pressure plate springs 17, and is forcibly isolated from the feed roller 11 by cams 26*b* and 28 provided on the feed shaft 10. These pressing and isolating actions applied to the pressure plate 16 are accomplished at prescribed timings in the feed operation (FIG. 8).

Next will be described the feeding/separating unit. By the action of the pressure plate 16 at a prescribed timing, the sheets mounted on the pressure plate 16 are pressed against the feed roller 11. Along with the pressing of the sheets, the feed roller 11 is rotationally driven, and the topmost sheet in contact with the feed roller 11 is fed out by the frictional force of the feed roller 11. Since the feed roller 11 conveys the sheets by its frictional force, preferable materials for the roller include rubbers with a relatively high friction coefficient such as ethylene-propylene diene terpolymer (EPDM) and foam urethane.

Next will be described the drive mechanism. FIG. 3 shows the drive mechanism of the automatic sheet feeding apparatus, which is the embodiment of the invention. In FIG. 3, reference numeral 21 denotes a reduction gear to which a driving force is transmitted from a drive power source (not shown), such as a feed motor; 22, a first conveyance roller gear pressed into and fixed to an end of a first conveyance roller 31 to turn this roller; and 23, a second conveyance roller gear pressed into and fixed to an end of a second conveyance roller 32 to turn this roller. Further, reference numeral 24 denotes a first oscillating gear train for driving a feed shaft gear 26 fixed to the feed shaft 10 on the basis of the rotation of the first conveyance roller 31, and this first oscillating gear train 24 comprises an A sun gear, a planet gear, an oscillating member, oscillating load generating means and so forth. Reference numeral 25 denotes a second oscillating gear train for driving a control gear 27 on the basis of the rotation of the second conveyance roller 32, and the second oscillating gear train 25 also comprises an A sun gear, a planet gear, an oscillating member, oscillating load generating means and so forth.

Reference numeral 26 denotes the feed shaft gear for transmitting driving force to the feed shaft 10 by being fixed to one end of the feed shaft. Reference numeral 27 denotes the control gear for controlling the return lever 13 and the separation roller 12. The driving force transmitted from a driving power source (not shown), such as a feed motor, turns the reduction gear 21 in the direction of arrow P or Q in FIG. 3. When the reduction gear 21 is turned in the direction of arrow P (clockwise in the illustration), the driving force is transmitted to the feed shaft gear 26 via the first conveyance roller gear 22, the first conveyance roller 31 and the first oscillating gear train 24 while undergoing speed reduction to turn the feed shaft gear 26 in the direction of R in FIG. 3. This driving force is further transmitted to the ASF (automatic sheet feed) control gear 27. However, as the feed shaft gear 26 and the control gear 27 are linked to each other at a reduction ratio of 1:1, they always turn in a synchronized angular phase. The feed shaft gear 26 is provided with a toothless area 26*a*, and the range in which the feed shaft gear 26 is turned via the first oscillating gear train 24 is from the initial state to this toothless area 26*a*.

On the other hand, when the reduction gear 21 turned in the direction of arrow Q (counterclockwise in the illustration), the driving force is transmitted to the control gear 27 via the second conveyance roller gear 23, the second conveyance roller 32 and the second oscillating gear train 25 while undergoing speed reduction to turn the control gear 27 in the direction of arrow S in FIG. 3. This driving force is further transmitted to the feed shaft gear 26. However, since the feed shaft gear 26 and the control gear 27 are linked to each other at a reduction ratio of 1:1 as stated above, they always turn in a synchronized angular phase. By turning the control gear 27 and the feed shaft gear 26 via this second oscillating gear train 25, the toothless area 26*a* of the feed shaft gear 26 can be shifted away from the opposite face to the first oscillating gear train 24. The feed shaft gear 26 can be thereby returned to its initial state.

A cam (not shown) is formed on one face of the control gear 27, and this cam serves to vary the position of the return lever 13 in the turning direction and pressing the separation roller 12 against, or releasing it from, the feed roller 11. The isolation of the pressure plate 16 from the feed roller 11 is accomplished with the cam 26*b* disposed coaxially with the feed shaft gear 26. Also at the other end of the feed shaft 10 than that toward the feed shaft gear 26, the cam 28 is provided. This cam 28 has the same function as the cam 26*b*, so configured as to rotationally shift the pressure plate 16 uniformly by pressing both ends of the pressure plate 16 at the same time.

The feeding/separating unit will be described again. With reference to FIG. 4, the feed shaft 10 is provided with the flanges 14 in three positions in the axial direction in addition to the feed roller 11 disposed in one position as shown in FIG. 4A. The side view of the feed roller 11 is as shown in FIG. 4B. The shape of the feed roller 11 in this embodiment is composed of a sheet conveying face 11*a* corresponding to a cylindrical outer circumferential face and a non-conveying face 11*b* consisting of a face escaping from the sheets. When a sheet is to be fed by turning the feed roller 11, the sheet is moved (fed) by the sheet conveying face 11*a*. The non-conveying face 11*b* is intended to prevent a backward load from being generated by the touching of the feed roller 11 with a sheet when the sheet having gone through feeding is being processed (e.g. recorded on).

The outer circumference of the flange 14, as shown in the side view of FIG. 4C, is composed of a blocking area 14*a* for completely blocking the sheet conveying path by overlapping with the return lever 13 in a side view as shown in FIG. 5, a restricting area 14*b* for stabilizing the posture of the sheet by restricting the floating or the like of the sheet being fed, and an escaping area 14*c* for isolating a sheet being recorded upon from the sheet conveying path to prevent the sheet from being touched. Regarding the blocking area 14*a* to overlap with the return lever 13 in a side view will be described in further detail afterwards together with the overlap feeding prevention unit.

The restricting area 14*b* for stabilizing the posture of the sheet being fed is smaller than the outer diameter the sheet conveying face 11*a* of the feed roller 11 by 0.5 mm to 1 mm. It prevents, even when one end of it is fed by the feed roller 10, the sheet from floating and thus skewing or invite jamming of sheets. The escaping area 14*c* for isolating a sheet being recorded upon from the sheet conveying path to prevent the sheet from being touched is so composed, for a similar purpose to that of the non-conyeying face 11*b* of the feed roller 11, as to minimize any unnecessary backward load on an already fed sheet being recorded upon.

Whereas the topmost one of the sheets stacked on the feed roller 11 is to be conveyed in a feeding action, basically only the topmost sheet is conveyed because in general the frictional force between the feed roller 11 and the topmost sheet is greater than that between the topmost sheet and the sheet immediately underneath. However, when any burr at the ends of sheets left by their cutting has some influence, sheets are stuck together by electrostatic force or sheets with a particularly high surface frictional coefficient are used for instance, the feed roller 11 may take out a plurality of sheets at a time. As precaution against such cases, only the topmost sheet is separated and fed in this embodiment by using the means to be described below.

Thus, the separation roller 12 is so urged (pressed) toward the feed roller 11 that it may come into contact at a farther downstream point than where the feed roller 11 and sheets first come into contact with each other as shown in FIG. 6. The separation roller 12, having a built-in torque limiter, does not actively turn. However, the spindle of this torque limiter is fixed, and a metallic or plastic coil spring is accommodated between this fixed spindle and the torque limiter. When the separation roller 12 has turned to a prescribed angle and the coil spring has wound around the fixed spindle, a relative slip occurring between this coil spring and the fixed spindle enables a prescribed constant torque (load torque) to be maintained. The surface of the separation roller 12 is formed of rubber or foam urethane so that it has a friction coefficient of about the same level as that of the feed roller 11.

This configuration enables the torque limiter to turn following the rotation of the feed roller 11 when there is no sheet between the feed roller 11 and the separation roller 12. When one sheet comes in between the feed roller 11 and the separation roller 12, the sheet is conveyed while causing the separation roller 12 to follow because the frictional force between the feed roller 11 and the sheet is greater than that between the separation roller 12 which follows in rotation at a prescribed torque. However, when two sheets come in between the feed roller 11 and the separation roller 12, a slip occurs between the two sheets because the frictional force between the feed roller 11 and the sheet on the feed roller side (the topmost sheet) is greater than that between the two sheets and the frictional force between the sheet on the separation roller side and the separation roller 12 is greater than that between the two sheets. As a result, only the sheet on the feed roller side is conveyed, but that on the separation roller side stops in that position along with the non-rotation of the separation roller 12, and is not conveyed. The separating unit using the separation roller 12 is configured and operates as described so far.

Next will be described the overlap feeding prevention unit. It is possible to separate two or so sheets that may enter into the nip portion between the feed roller 11 and the separation roller 12 can be separated. However, if more sheets come in or two or three sheets come in, and then after the conveyance of only the sheet on the feed roller side the next sheet is to be fed leaving the other one or ones of the preceding sheets in the vicinity of the nip portion, a plurality of sheets may be conveyed at the same time. The overlap feeding prevention unit is provided to prevent this overlap feeding. The main constituent member of the overlap feeding prevention unit is the return lever 13. The basic actions of the return lever 13, which operates in synchronism with the rotation of the control gear 27 in the direction of arrow S. The operation of the return lever 13 will be described in conjunction with the motions of the feed roller 11, the flange 14 and the pressure plate 16 because it is closely related to their actions.

Figure 7:
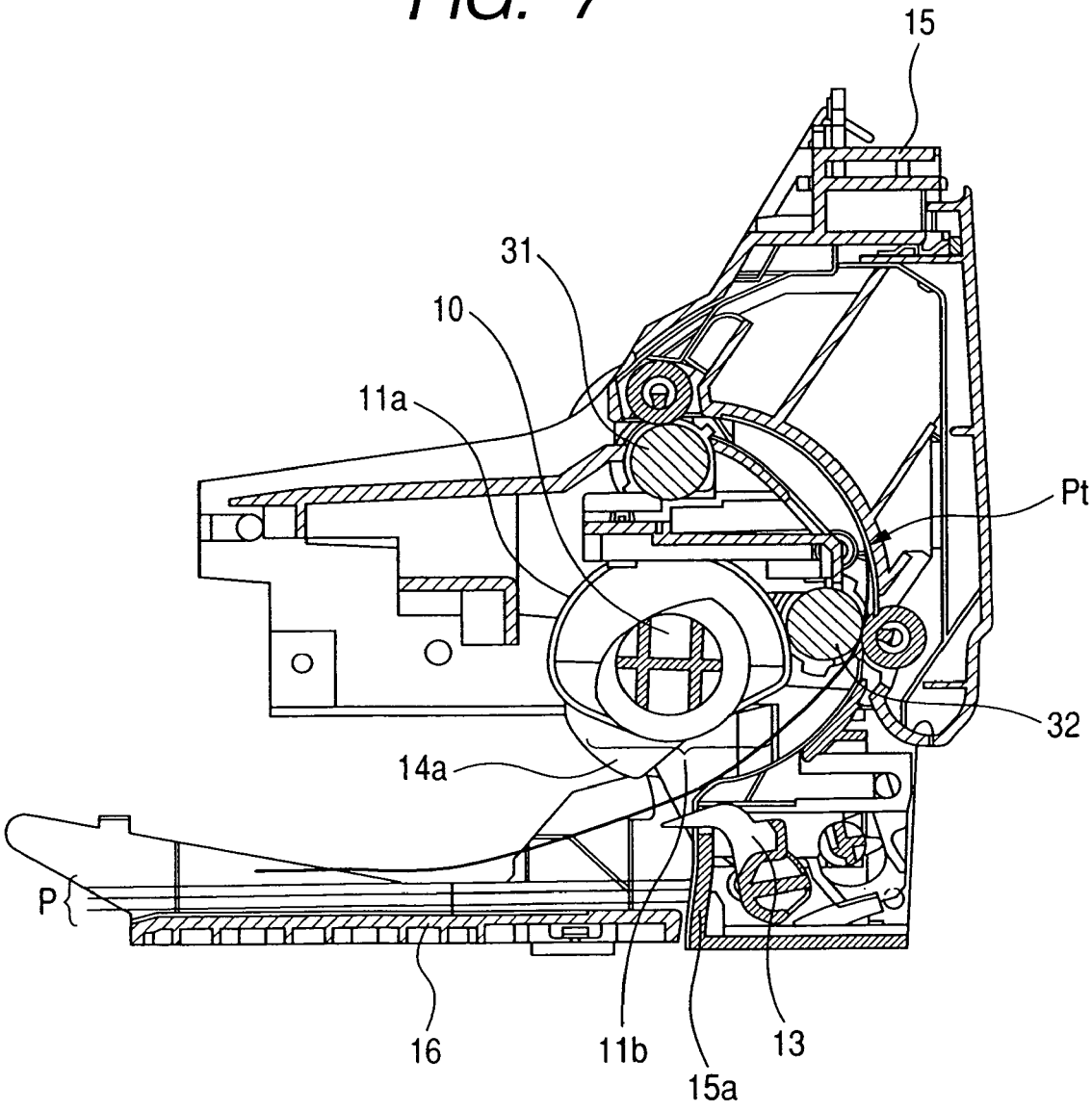
FIG. 7 shows a vertical section of the automatic sheet feeding apparatus of FIG. 5 in a state of having ended the feeding operation and completed preparations for recording on the sheets and other processing.

FIGS. 5, 6 and 7 are vertical sections illustrating the actions of the feed roller 11, the flanges 14, the return lever 13 and the pressure plate 16 in the automatic sheet feeding apparatus embodying the invention in this mode. FIG. 5 shows a state of standing by for feeding; FIG. 6, one of feeding operation; and FIG. 7, one of having ended the feeding operation and completed preparations for recording on the sheets and other processing. In this embodiment, the return lever 13 is so pivoted as to be turnable around an axis parallel to the feed shaft 10, and its rotational position is controlled in synchronism with the rotation of the control gear 27, engaged with the feed shaft gear 26, in the direction of arrow S. This return lever 13 basically takes three positions including the first, second and third positions to be described below.

FIG. 5 shows a state of standing by during one turn of the feed roller 11. The position of the return lever 13 in this state of standing by is its first position. Referring to FIG. 5, the leading edges of sheets P loaded in a horizontal position on the pressure plate 16 are aligned in a state of being pressed against the leading edge reference part 15*a*. The blocking area 14*a* (which overlap with the return lever 13 in a side view,) of each flange 14, which integrally operates (turns) with the feed roller 11, protrudes over the sheet conveying path, and the tip of the return lever 13 also protrudes over the sheet conveying path. Therefore, in the state of standing by during one turn of the feed roller 11, the passing route of sheets is completely closed because of the relationship in terms of rotational position between the flanges 14 and the return lever 13. By arranging a standby position to forbid sheets from entering onto the passing route in this way, the sheet conveying face 11*a* of the feed roller 11 can be utilized longer, more effectively and free from waste, and moreover the rush-in phenomenon, namely letting the leading edge of sheets enter deep into the feeding apparatus inadvertently at the time of setting the sheets into the sheet stack holding unit, can be eliminated.

The position of the return lever 13 in the state of feeding operation as shown in FIG. 6 is its second position. Referring to FIG. 6, the leading edges of sheets P fed out by the feed roller 11 have not yet reached the second conveyance roller 32. The return lever 13 in feeding operation is in a position in which it can completely escape from the sheet conveying path so that it may not obstruct the conveyance of sheets in separated transit.

The position of the return lever 13 in the state of having ended the feeding operation and then having completed preparations for recording on the sheets and other processing, as shown in FIG. 7 is its third position. Referring to FIG. 7, whereas the leading edge of a sheet P has just arrived at the second conveyance roller 32 as illustrated, the sheet is fed in as it is and, when the leading edge of the sheet P has reached a sheet processing unit, such as a recording unit, recording or some other action is done on the sheet. When the return lever 13 reaches this third position, the sheets left on the separation roller 12 (multiply fed sheets) while the return lever 13 was turning from its second position to third position are fully pressed back by the tip of the return lever 13 until their leading edges reach the leading edge reference part 15*a*.

This third position is selected to be completely isolated from the sheet conveying path, by turning the return lever 13 from its first position in FIG. 5 farther counterclockwise in the illustration so that it may not touch the sheet undergoing recording or any other processing or impose a backward load. By this time, the non-conveying face 11*b* of the feed roller 11 has reached a position in which it is opposite the sheet being conveyed, and accordingly the sheet conveying face 11*a* does not touch the sheet. For this reason, no unnecessary backward load is imposed by the feed roller 11 on the sheet undergoing recording or any other processing. Similarly, the blocking areas 14*a* of the flanges 14 which overlap with the return lever 13 in a side view also is in a position where they are unable to touch the sheet being conveyed, and therefore no unnecessary backward load is imposed by any of the flanges 14 on the sheet being processed.

FIG. 8 is a timing chart showing the mutual relationships of the operations of the constituent elements of the automatic sheet feeding apparatus, which is the embodiment of the invention. Next, the sequence of operations of these mechanisms and their relationship will be described with reference to the timing chart of FIG. 8. In FIG. 8, an angle of 0 degree (the 0 degree angle of the feed roller 11) represents the standby state of FIG. 5. In the sheet feeding apparatus of this embodiment, a sequence of operations starts from the position of the standby state shown in FIG. 5. In the state of the angle of 0 degree, the pressure plate 16 is held in a position isolated from the feed roller 11 by the pressure plate cams 26*b* and 28 on the feed shaft; the return lever 13 is in the first position shown in FIG. 5, entering onto the sheet passage-(conveying path); the separation roller 12 as the sheet separating means in an escape position; and the non-conveying face 11*b* of the feed roller 11 is opposite the separation roller 12.

Then, when the feed roller 11 reaches an angle θ1, the separation roller 12 begins to shift from its standby position to pressing position. Next, when the feed roller 11 reaches an angle θ2, the sheet conveying face 11*a* of the feed roller comes into contact with the separation roller 12 with the return lever 13 remaining in its first position of FIG. 5, and further the pressure plate 16 begins to gradually rise toward the feed roller 11. Then, as the separation roller 12 turns following the sheet conveying face 11*a* of the feed roller 11, the torque limiter provided on the separation roller 12 is charged to a prescribed torque. Then at an angle θ3, the return lever 13 shifts (rotates) in a stroke from the first position of FIG. 5 to the second position of FIG. 6 to completely escape from the feed passage of sheets.

Next, in the vicinity of an angle θ4, the pressure plate 16 is completely released from the holding by the pressure plate cams 26*b* and 28, and begins to be pressed against the feed roller 11. Then, the topmost one of the sheets stacked on the pressure plate 16 is pressed against the feed roller 11. When the sheet is pressed against the feed roller 11 in this way, the conveyance (feeding) of the sheet described above is started. For some time onward from this point, sheets are consecutively conveyed and, when a plurality of sheets have been conveyed as described above, one sheet separated by the separating unit or otherwise is conveyed to the recording unit or the like (in the direction of arrow Y in FIG. 1). When the edge of the topmost sheet is pinched by the nip portion of the second conveyance roller 32 on the upstream side in the conveying direction and the synergetic conveyance by the conveyance roller 32 and the feed roller 11 begins, the feeding sequence enters into the phase of overlap feeding prevention described above.

Then, in the vicinity of an angle θ5, the operation to isolate the pressure plate 16 by the pressure plate cams 26*b* and 28. When the pressure plate 16 is isolated, as the sheets are released from the main source of pressure against the feed roller 11, the force to convey the sheets is weakened. Further, immediately after this, it comes to be faced by the non-conveying face 11*b* of the feed roller 11 to pressure plate 16. However, as the separation roller 12 and the feed roller 11 remain pressed, the conveyance of sheets continues.

Next, in the vicinity of an angle θ6, the action of the return lever 13 to prevent overlap feeding is started. This overlap feeding prevention is accomplished by an action, when the return lever 13 turns from its second position to third position counterclockwise in the illustration, to scrape back superfluous sheets which have been fed out, with their leading edges ahead, toward the sheet stack holding unit and to push back the leading edges to the leading edge reference part 15*a* to align them. Thus, once this overlap feeding prevention action is started, the feed roller 11 begins to be released from the pressure against the separation roller 12 in the vicinity of an angle θ7. When it is released from this pressure, as the force to press the sheets against the feed roller 11 is lost, so is the force to the sheets on the sheet feeding apparatus side, with the result that the sheets are held by the second conveyance roller 32. At the time when the force to the sheets on the sheet feeding apparatus side is lost, the return lever 13 begins to enter onto the sheet passage path.

Then, if the leading edges of the sheets taken out to the vicinity of the nip portion between the feed roller 11 and the separation roller (retard roller) 12 (the other sheets than the topmost) remain, the tip of the return lever 13 scrapes back the leading edges of the sheets toward the stack holding unit where they came from. Next, in the vicinity of an angle θ8, the return lever 13 is fully returned to its third position of FIG. 7; all other sheets than that conveyed by the second conveyance roller 32 are conveyed in the reverse direction (returned); and their tips are shifted (returned) to the leading edge reference part 15*a*. Recording on or other processing of the topmost sheet having been fed is accomplished at 9 print while the state of the angle θ8 is maintained.

Finally, the discharging of the rear edge of the sheet out of the automatic sheet feeding apparatus is confirmed with a sensor or the like disposed on the apparatus body, and the return lever 13 is returned to its first position of FIG. 5 in the vicinity of an angle θ9. In this one turn of the feed roller 11 so far described, the sheet feeding sequence performed by the constituent mechanisms of the automatic sheet feeding apparatus is completed, followed by another turn of the feed roller 11 to feed the next sheet.

As hitherto described, the sheet conveying path is returned to the completely closed (blocked) initial state by controlling the positional relationship between the blocking areas 14*a* of the flanges 14 which overlap with the return lever 13 in a side view and the return lever 13 and returning the feed roller 11 to the state of the 0 degree angle. Accordingly, it is possible to effectively prevent the tips of sheets from being allowed to enter deep into the feeding apparatus inadvertently at the time of setting the sheets into the sheet stack holding unit. The sequence of controlling the automatic sheet feeding apparatus synchronized with one turn of the feed roller 11 is hereby completed.

The automatic sheet feeding apparatus which embodies the invention in the hitherto described mode has a configuration in which the feed roller 11 and the return lever 13 do not overlap with each other but the flanges 14 and the return lever 13 do overlap in a side view during one turn of the feed roller 11, and in the standby position the sheets P are forbidden from entering onto the sheet passage. Therefore, it is made possible to provide an automatic sheet feeding apparatus in which the sheet conveying face of the feed roller can be utilized without waste and sheets can be prevented from rushing into the sheet feeding apparatus at the time of setting them into the sheet stack holding unit, and a recording apparatus having such an automatic sheet feeding apparatus.

In addition, although the foregoing description of the embodiment of the invention supposes that the automatic sheet feeding apparatus is mainly used with a recording apparatus, the invention can also be applied with similar effectiveness to separated feeding of sheets in a reading apparatus. The automatic sheet feeding apparatus according to the invention can be applied with similar effectiveness to any type of recording apparatus, be it a thermal transfer, thermosensitive, ink jet, laser beam, wire dot or any other type.

Since this embodiment of the invention does not cause the return lever to overlap with the feed roller, it is made possible to provide an automatic sheet feeding apparatus in which the sheet conveying face of the feed roller can be utilized without waste and sheets can be prevented from rushing into the sheet feeding apparatus at the time of setting them into the sheet stack holding unit, and a recording apparatus having such an automatic sheet feeding apparatus.

This application claims priority from Japanese Patent Application No. 2004-175222 filed on Jun. 14, 2004, which is hereby incorporated by reference herein.

What is claimed is:

1. A sheet feeding apparatus, comprising:

a stack holding unit on which sheets are to be stacked;

a feed shaft on which a feed roller for feeding a sheet stacked on said stack holding unit and a flange are coaxially arranged, wherein said feed roller comprises a conveying face, in contact with the sheet stacked on said stack holding unit, for conveying the sheet, and a non-conveying face being spaced from the sheet stacked on said stack holding unit, and said flange comprises a first area protruded beyond a peripheral surface of said feed roller, for blocking a sheet conveying path, and a second area which has a radius smaller than a radius of the conveying face of said feed roller and being spaced from the conveying path;

a separating roller in contact with the feed roller, for separating sheets; and a return lever for returning sheets conveyed downstream from said separating roller to said stack holding unit, said return lever being arranged at a position different from the flange in an axial direction of said feed shaft, wherein the flange turns integrally with the feed roller, and a radius of the first area is larger than the radius of the second area, and wherein when the feed roller is in a standby state, said return lever is moved at a first position for blocking the sheet conveying path and said flange is located at a sheet conveying path blocking position where the first area of the flange and said return lever overlap each other as viewed from a direction parallel to said feed shaft.

2. The sheet feeding apparatus according to claim 1, wherein:

said return lever can be rotated downstream from the first position in the sheet conveying direction to a second position being away from the sheet conveying path, and can be moved to a third position where the sheet is returned to said stack holding unit.

3. The sheet feeding apparatus according to claim 1, wherein:

said flange is disposed in each of a plurality of positions in the axial direction of said feed roller.

4. A recording apparatus for recording on sheets with recording means, comprising:

a mounting unit for mounting the recording means;

a stack holding unit on which sheets are to be stacked;

a feed shaft on which a feed roller for feeding a sheet stacked on said stack holding unit and a flange are coaxially arranged, wherein said feed roller comprises a conveying face, in contact with the sheet stacked on said stack holding unit, for conveying the sheet, and a non-conveying face being spaced from the sheet stacked on said stack holding unit, and said flange comprises a first area protruded beyond an a peripheral surface of said feed roller, for blocking a sheet conveying path, and a second area which has a radius smaller than a radius of the conveying face of said feed roller and being spaced from the conveying path;

a separating roller in contact with the feed roller, for separating sheets; and a return lever for returning sheets conveyed downstream from said separating roller to said stack holding unit, said return lever being arranged at a position different from the flange in an axial direction of said feed shaft, wherein the flange turns integrally with the feed roller, and a radius of the first area is larger than the radius of the second area, and wherein when the feed roller is in a standby state, said return lever is moved at a first position for blocking the sheet conveying path and said flange is located at a sheet conveying path blocking position where the first area of the flange and said return lever overlap each other as viewed from a direction parallel to said feed shaft.

5. The recording apparatus according to claim 4, wherein;

said return lever can be rotated downstream from the first position in the sheet conveying direction to a second position being away from the sheet conveying path, and can be moved to a third position where the sheet is returned to said stack holding unit.

6. The recording apparatus according to claim 4, wherein:

said flange is disposed in each of a plurality of positions in the axial direction of said feed roller.

7. The sheet feeding apparatus according to claim 1, wherein during one turn of said feeding roller, said return lever and the feeding roller do not overlap with each other, in a view of a direction parallel to said feed shaft.

8. The recording apparatus according to claim 4, wherein during one turn of said feeding roller, said return lever and the feeding roller do not overlap with each other, in a view of a direction parallel to said feed shaft.

9. The sheet feeding apparatus according to claim 1, wherein the sheets are set in said stack holding unit from a front side of an apparatus body.

10. The recording apparatus according to claim 4, wherein the sheets are set in said stack holding unit from a front side of an apparatus body.

11. The recording apparatus according to claim 10, wherein the sheet fed by said feed roller is conveyed to a position opposite to said recording means with its front and back sides reversed each other.

12. The recording apparatus according to claim 11, wherein an opposite sheet side to a sheet side with which said feed roller touches is recorded by said recording means.

* * * * *